US005741558A

United States Patent [19]

Otani et al.

[11] Patent Number: 5,741,558

[45] Date of Patent: Apr. 21, 1998

[54] METHOD AND APPARATUS FOR COATING THREE DIMENSIONAL ARTICLES

[75] Inventors: Tatsuo Otani, Tokyo; Hidetaka Tsukamoto, Suita; Makoto Sekiguchi, Nagoya, all of Japan

[73] Assignee: Nordson Corporation, Westlake, Ohio

[21] Appl. No.: 530,142

[22] PCT Filed: Apr. 7, 1994

[86] PCT No.: PCT/US94/03828

§ 371 Date: Jun. 24, 1996

§ 102(e) Date: Jun. 24, 1996

[87] PCT Pub. No.: WO94/22589

PCT Pub. Date: Oct. 13, 1994

[30] Foreign Application Priority Data

Apr. 7, 1993 [JP] Japan ..... 5-105168

[51] Int. Cl.[6] ..... B05D 1/02; B05D 1/06; B05B 5/00; B05C 19/00

[52] U.S. Cl. ..... 427/469; 118/308; 118/310; 118/313; 118/315; 118/324; 118/668; 118/669; 118/679; 118/683; 118/696; 118/621; 427/475; 427/479; 427/483; 427/424; 239/67; 239/69

[58] Field of Search ..... 118/308, 310, 118/313, 319, 324, 668, 669, 676, 677, 679, 683, 684, 696, 697, 621, 622, 627; 427/466, 469, 475, 477, 479, 424, 483, 180, 189; 239/67, 68, 69

[56] References Cited

U.S. PATENT DOCUMENTS

| | | |
|---|---|---|
| 3,054,697 | 9/1962 | Irland et al. . |
| 3,245,376 | 4/1966 | Romstadt . |
| 3,263,127 | 7/1966 | Point et al. . |
| 3,556,255 | 1/1971 | Lomax, Jr. . |
| 3,593,308 | 7/1971 | Fagan . |
| 3,594,211 | 7/1971 | Drum . |
| 3,691,991 | 9/1972 | Luderer et al. . |
| 3,777,702 | 12/1973 | Fitzgerald . |
| 4,448,819 | 5/1984 | Buschor . |
| 4,572,103 | 2/1986 | Engel . |
| 4,614,300 | 9/1986 | Falcoff . |
| 5,056,462 | 10/1991 | Perkins et al. . |
| 5,131,350 | 7/1992 | Buschor . |
| 5,202,214 | 4/1993 | Kawamorita et al. . |
| 5,217,745 | 6/1993 | Patel . |
| 5,280,433 | 1/1994 | Ettinger et al. . |

FOREIGN PATENT DOCUMENTS

| | | |
|---|---|---|
| 1087191A | 4/1984 | U.S.S.R. . |
| 1323138A | 7/1987 | U.S.S.R. . |
| 1358998A | 12/1987 | U.S.S.R. . |
| 2169724 | 7/1986 | United Kingdom . |

*Primary Examiner*—Steven P. Griffin
*Attorney, Agent, or Firm*—Wood, Herron & Evans L.L.P.

[57] ABSTRACT

A method and apparatus (10) for powder coating three dimensional articles (12) carried on a conveyor (14) includes a controller (36) for controlling the rate at which coating material is discharged from a gun (16), so that the rate is proportional to the surface area of the surface portions of the article (12) as they pass the gun (16). Some surface portions topographically have a greater surface area which must be covered, while others are flat or have cut-out regions, requiring less coverage or no coverage at all. In powder coating operations, the discharge rate is controlled via automatic or programmed control of an electro-pneumatic air regulator (42) which regulates the supply of pressurized air to a powder pump (24) connected to the spray gun (16). The apparatus (10) assures uniformity in coating for a three dimensional article (12) with multiple surface portions of varying topography such as curves, angles, cut outs, etc., while minimizing the amount of wasted coating material.

21 Claims, 4 Drawing Sheets

METHOD AND APPARATUS FOR COATING THREE DIMENSIONAL ARTICLES

FIELD OF THE INVENTION

This invention relates to an improved method and apparatus for powder coating three dimensional articles having surface irregularities which vary in angle, curvature, and/or surface area.

BACKGROUND OF THE INVENTION

One common method and apparatus for coating three dimensional articles involves spray coating powder particles onto the external surface of the articles as they are conveyed by a conveyor past a spray gun. Typically, a sensor detects when an article carried by the conveyor moves into the spray pattern of the gun and signals the apparatus to spray a preset uniform quantity of powder particles to coat the article. Thus, to coat a plurality of articles, the apparatus intermittently sprays a preset, uniform quantity of coating material onto each article as the articles pass the gun.

This manner of coating three dimensional articles is generally acceptable if all of the articles have a flat coating surface, or a surface which is parallel to the conveyor and perpendicular to the orientation of the gun.

However, with three dimensional articles which have surface irregularities such as cut-out regions, angled or curved surfaces, protrusions, indentations, or bent edges, etc., these surface irregularities make it difficult to uniformly coat the entire external surface of the article. One reason for this difficulty relates to the angular orientation of the surface irregularities with respect to the direction of the gun. The more the surface varies from an orientation perpendicular to the spray direction, the more difficult it becomes to adequately coat the surface. For curved or angled surfaces difficulty in coating occurs in part because an angled or curved surface has a greater density of surface area than a flat surface. This means that as the conveyor moves the three dimensional articles past the spray gun, the surface area per unit time which passes the gun is greater for angled or curved surfaces than for flat surfaces. Additionally, some surface irregularities are actually cut-out regions, which require no coating at all. Continued operation of a spray gun as a cut-out region passes by represents a waste of coating material.

Thus, as the topography of the three dimensional article varies, it becomes more difficult to uniformly coat the entire surface area, particularly for conveyors commonly used in the industry which convey such articles past the spray gun at a relatively constant speed.

One way to assure that the entire surface is coated is to operate the spray gun at a sufficiently high pressure to discharge a quantity of coating material which is greater than that which is actually necessary to coat the surface, with the pressure being determined by the portion of the surface which is most difficult to coat. This assures some coating on the most steeply angled or curved surfaces. However, a coating applied in this manner is generally not uniform due to the surface irregularities. This manner of coating also results in a tremendous amount of wasted energy and coating material.

It is an objective of this invention to improve uniformity in coating three dimensional articles with surface irregularities.

It is another objective of this invention to adequately coat the irregular surface areas of a three dimensional article while minimizing the amount of wasted coating material.

SUMMARY OF THE INVENTION

The above-stated objectives are achieved by a method and apparatus which control the discharge rate of coating material according to the irregularity and/or area of the surface of a three dimensional article as it is conveyed past a spray gun. For powder spray coating applications, the discharge rate is controlled by regulating the air pressure input to the powder pump. This controls the volume of powder mixed into the conveying air stream moving through the pump and the rate at which the mixed powder-air stream is discharged from a spray gun toward the three dimensional article. For flat surfaces, a standard reference discharge rate is used. For steeply curved surface portions, the discharge rate increases commensurately to assure adequate coating of the increased surface density which moves past the gun per unit time. For cut-out regions, discharge of the powder is temporarily stopped to reduce waste.

Depending upon the dimensions of the articles to be coated, more than one spray gun may be necessary. Each spray gun is adapted to coat along a topographical strip, or channel, of the external surface of the article. The discharge rate for a gun dedicated to a particular channel is predetermined to correspond to the particular irregularities of the surface portions of that channel. Each gun is controlled independently, so that each channel of the three dimensional article is coated according to a predetermined discharge sequence which corresponds uniquely to the configuration of the surface portions thereof.

By varying the discharge rate in accordance with curvature and/or surface area of the surface portions as they pass in front of a gun along a conveying path, this invention assures uniform coating of all surface portions of the article, regardless of surface irregularities. Additionally, because the discharge rate is lowered for flat surfaces, and discharge is discontinued entirely for cut-out regions, this invention reduces the amount of coating material which is wasted during the coating of three dimensional articles.

According to a preferred embodiment of the invention, a method and apparatus for coating three dimensional articles includes a conveyor, a spray gun, a powder pump, a powder hopper, a pressurized air source, a master controller, and electro-pneumatic air regulator, a position sensor for articles on the conveyor and a speed sensor for the conveyor. The conveyor carries three dimensional articles in spaced relation along the conveying path, which is oriented perpendicular to the discharge path of the spray gun. Stated another way, the discharge path of the spray gun intersects the conveying path at a 90° angle. The powder pump conveys a mixed stream of pressurized air and powder particles to the gun via a transport hose. The powder hopper, preferably a fluidized bed, supplies powder particles to the powder pump. The pressuried air source supplies pressurized air via a supply tube to the powder pump. The electro-pneumatic air regulator is connected in the supply tube between the pressurized air source and the powder pump, and the electro-pneumatic air regulator regulates the flow rate of pressurized air supplied to the powder pump. Because the amount of powder particles drawn into the powder pump is directly proportional to the flow rate therethrough, this also controls the discharge rate from the gun.

The controller operatively connects to the electro-pneumatic air regulator and controls operation thereof according to a predetermined discharge sequence, the sequence initially determined by an operator to uniformly coat a topographical channel of the three dimensional article as the various surface portions thereof pass in front of the gun. A position sensor senses movement of an article by the conveyor into the discharge path of the gun, and thereby activates the controller to initiate the predetermined coating sequence. The conveyor speed sensor operatively connects to the controller and signals to the controller the speed of the conveyor, thereby to correlate the predetermined discharge sequence with the actual speed of the conveyor. Stated another way, the speed sensor serves as a feedback device to the controller to assure that the predetermined coating sequence actually matches the topography of the surface portions of the channel as the article is transported in front of the gun.

An air pressure sensor may be located in the supply line between the electro-pneumatic air regulator and the pump, thereby to sense and provide an indication of the air pressure in the line. If desired, this air pressure can be calculated to determine, and provide a display of, the discharge rate from the gun.

Depending upon the transverse dimension of the articles to be coated and/or the variations in surface topography for the articles to be coated, one or more additional surface channels may be designated. This will necessitate the use of one or more additional guns, along with the corresponding additional powder supply apparatus. This additional powder supply apparatus functions in the same manner as described above, and discharge from each gun is independently controlled by the master controller. However, only a single air supply source is necessary, with a control valve located downstream thereof and operatively connected to the master controller, thereby to turn "off" or "on" all pressurized air flowing into the apparatus.

These and other features of the invention will be more readily understood in view of the following detailed description and the drawings.

DETAILED DESCRIPTION OF THE DRAWINGS

Figure 1:
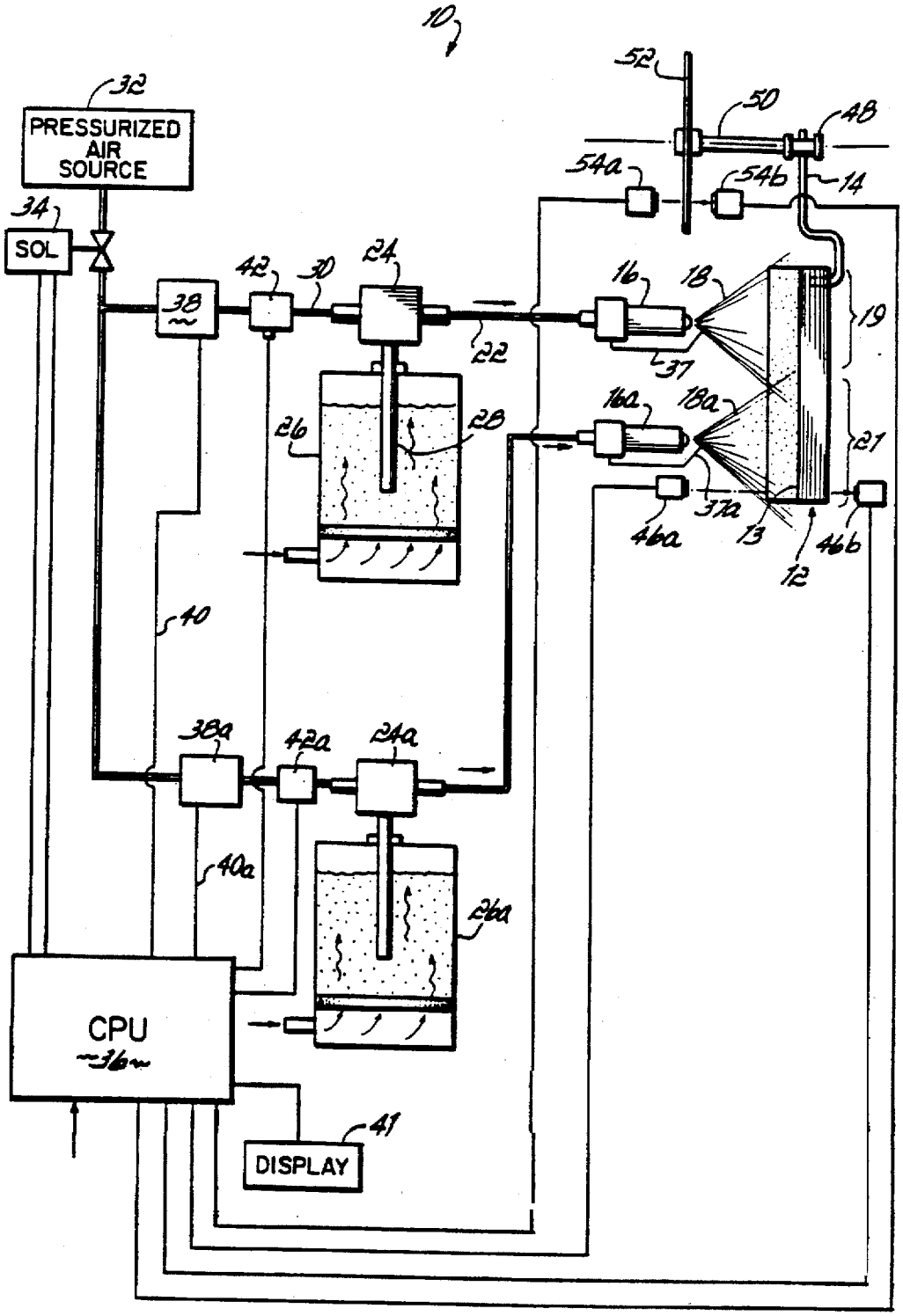
FIG. 1 is a schematic of a powder coating apparatus for coating three dimensional articles, in accordance with a preferred embodiment of the invention.

FIG. 1 schematically shows an improved spray coating apparatus 10 for powder coating a three dimensional article 12 in accordance with a preferred embodiment of the invention. While the figures show an apparatus 10 particularly suitable for powder coating, the invention is not limited thereby and is also applicable to other types of coating and coating materials. More specifically, the apparatus 10 coats a first external surface 13 of three dimensional articles 12 carried by a conveyor 14. The conveyor 14 moves the articles 12 along a conveying path and past a spray coating gun 16. The gun 16 is adapted to spray coating material along a discharge path which intersects the conveying path of the conveyor 14 at 90°. This discharge path is defined by a conical-shaped pattern 18 which is formed during operation of the gun 16 under high pressure discharge conditions.

As shown in FIG. 1, the first external surface 13 of article 12 includes first and second widths, or topographic channels 19 and 21, respectively. As shown in FIG. 1, channel 19 is located above channel 21, though this invention is not limited to the use of a horizontal conveying path and a horizontal discharge path, and the channels may reside next to each other in the X, Y or Z planes. The number of channels depends upon the transverse dimension of the first external surface 13 with respect to the direction of the conveyor 14. As shown in FIG. 1, the conveyor 14 moves the articles 12 along a conveying path which comes out of the page, and thus the transverse dimension of external surface 13 is along the vertical, or y-axis. Another factor which plays a role in determining the number of channels, in addition to the transverse dimension, is the surface variation of the first external surface 13. For instance, channel 21 has a cut-out region while channel 19 does not.

In addition to the gun 16 for discharging coating material in a conical-shaped pattern 18 toward the first channel 19 of surface 13, FIG. 1 also shows a second gun **16*a* for discharging coating material in a conical-shaped pattern 18*a* toward the second channel 21. As described above, depending upon the number of channels and the surface configuration of first external surface 13, one or more additional guns may be added as necessary. The structural elements which supply coating material to second gun 16*a* are identical to the structural elements which supply first gun 16, and reference numerals for these elements are identical, but have an "a" appended thereto. To simplify the explanation of FIG. 1, only The elements associated with first gun 16** will be described.

A supply hose 22 conveys a mixed stream of pressurized air and powder paint coating material to the gun 16. A powder pump 24 creates this mixture of pressurized air and coating material. The pump 24 is mounted to the top of a powder hopper 26 which maintains a fluidized bed of powder coating material. Pump 24 includes a venturi pumping chamber under negative pressure which is connected by suction tube 28 to the fluidized bed of powder in hopper 26 to draw powder into pump 24.

A pressurized air supply tube 30 defines a flow path for conveying pressurized air from a pressurized air source 32 to the pump 24. This pressurized air creates the negative pressure condition in the venturi pumping chamber of pump 24 which draws powder from hopper 26 into the pump. The supply of pressurized air from pressurized air source 32 is turned "off" and "on" via a solenoid valve 34 which is controlled by a master controller 36. The master controller 36 is preferably programmable and includes a central processing unit.

An electro-pneumatic air regulator 38 is installed in the flow path defined by supply tube 30, between the pressurized air source 32 and the pump 24. Regulator 38 is preferably a voltage to pressure regulator manufactured by Nordson Corporation of Amherst, Ohio under Part No. 113,626. An electrical signal is provided to regulator 38 via a line 40 from controller 36 indicating the air pressure to be provided at the output of regulator 38. Regulator 38 is also described in applicant's copending U.S. Application Ser. No. 08/206,597, filed Mar. 3, 1994 which is hereby incorporated by reference in its entirety. Operation of this electropneumatic air regulator 38 regulates the flow of pressurized air along the tube 30, which in turn regulates the amount of negative pressure in the venturi pumping chamber of pump 24 and the flow rate of the mixed powder-air stream from hopper 26 along supply robe 22, and the discharge rate of powder coating material from gun 16. Supply tube 30 also includes an air pressure sensor 42 which is operatively connected to the master controller 36, and the master controller 36 includes or is operatively connected to a display 41, such as an LED or LCD, for displaying the air pressure in the tube 30.

The master controller 36 also connects to position sensors **46*a* and 46*b*, which may be a light beam detector, to sense movement of the article 12 into the discharge path of the gun 16. The signal generated by the sensors 46*a* and 46*b* may then be used to actuate the master controller 36** to initiate coating.

The master controller 36 is programmed to control the operation of the regulator 38 (and regulator **38*a*) according to a predetermined coating sequence. This coating sequence may involve increasing or decreasing the supply of pressurized air to the pump 24 from regulator 38, thereby to increase or decrease the discharge rate of coating material from the gun 16 in accordance with the particular surface configuration or topography of the channel 19 (and channel 21). For instance, if the surface channel 19 includes flat portions and angled portions or curved portions, i.e. portions not parallel to the conveying path, the surface area of the non-parallel portions which pass by the gun 16 per unit time will be greater than the surface area of the flat portions which pass by the gun 16 per unit time, assuming the conveyor 14 moves at a constant speed. As described in more detail below with respect to FIG. 2**, these uneven or non-parallel portions therefore require a higher discharge rate, with the discharge rate being commensurate with the slope of a tangent line to the surface.

If desired, the speed of the conveyor 14 may be fed back to the master controller 36. This may be done by fixing a rotatable spool 48 in contact with the conveyor 14 so that the spool 48 rotates upon movement of the conveyor 14. An axle 50 connects to the spool 48 and supports a disc 52 which rotates therewith. The disc 52 is coded via punched out regions at a diameter which corresponds to a location of light beam sensors **54*a* and 54*b*. As the disc 52 rotates, the passage or obstruction of the light beam between sensors 54*a* and 54*b* indicates to the master controller 36 the speed of the conveyor 14. In its simplest form, with uniformly spaced punch-out regions in the disc 52, this structure may be used simply to indicate to the master controller 36 the speed of the conveyor 14 and whether the conveyor 14 has stopped or started, via sensing at the controller 36 the rate of receipt of the "obstructed" and "unobstructed" signals. If the conveyor 14 always runs at the same speed to coat the same articles 12, this speed sensing structure may not be necessary, because the predetermined coating sequences can be correlated to the channel or channels of the article 12 in relation to that constant speed. However, this added degree of control is preferable because of possible fluctuations in the speed of the conveyor 14 and/or the desire to operate the conveyor 14 at different speeds for coating different articles 12**.

If desired, the coding on the disc 52 may be specific to a particular article 12, and arranged such that one complete rotation of disc 52 corresponds to movement of the conveyor 14 from the leading edge of one article 12 to the leading edge of the next succeeding article 12. Each surface portion to be coated can then be correlated to an arcuate section of the disc 52. The spacing of the cut out regions could then dictate the discharge rate. Thus, the invention contemplates added levels of feedback control, if desired.

Figure 2:
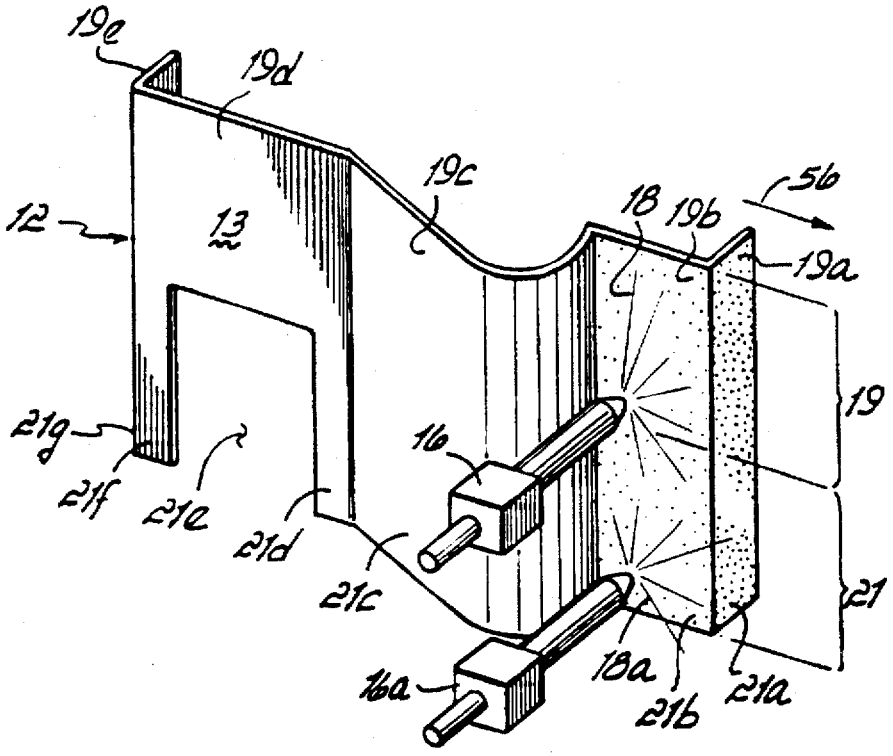
FIG. 2 is an enlarged perspective view of a portion of the apparatus shown in FIG. 1, showing the orientation of the spray guns with respect to a three dimensional article during coating thereof.

FIG. 2 shows the first external surface 13 of article 12 in greater detail. More particularly, FIG. 2 shows the topographic surface details of first upper channel 19 and second lower channel 21. The surfaces of channels 19 and 21 are coated by material discharged from gun 16 and **16*a*, respectively, as the article 12 moves along the conveying path in a direction designated by reference numeral 56. Channel 19 includes multiple surface portions, designated 19*a*, 19*b*, 19*c*, 19*d* and 19*e*. Surface portion 19*a* is oriented parallel to the discharge path of the gun 16 and perpendicular to the conveying path of the conveyor 14. Surface portion 19*b* is parallel to the conveying path and perpendicular to the discharge path. Surface portion 19*c* is curved, and a tangent line to this curve is almost parallel with the discharge path adjacent portion 19*b*, but becomes almost perpendicular to the discharge path as the surface portion 19*c* flattens, adjacent the flat or parallel surface portion 19*d*. Surface portion 19*e* is oriented parallel with the discharge path and perpendicular to the conveying path. Surface portions 21*a*, 21*b*, 21*c* and 21*d* are similar to surface portions 19*a*, 19*b*, 19*c* and 19*d*, respectively. However, channel 21 also includes a cut-out region 21*e* which does not require discharge of any coating material, followed by a flat surface portion 21*f* and a perpendicular surface portion 21*g***.

As shown in FIG. 2, if article 12 is moved past guns 16 and **16*a* at a constant rate of speed, a greater surface area of the article 12 passes the guns 16 and 16*a* per unit time during passage of those portions which are non-parallel to the conveying path i.e. such as portions 19*c* and 21*c*. Also, the greater the curvature, or angle of the surface portions with respect to the conveying path, the greater the amount of surface area which passes the guns 16 and 16*a* per unit time. Thus, to uniformly coat surface portions 19*b* and 19*c* with a layer of coating material of uniform thickness, and to minimize waste of coating material, more coating material must be discharged as portion 19*c* passes gun 16 than when portion 19*b* passes gun 16, assuming the conveyor 14 operates at constant speed. Subsequently, as surface portion 19*c* levels off toward surface portion 19*d*, the needed volume of coating material decreases. The effect is similar for channel 21, but channel 21 also includes cut-out 21*e***, which requires no coating material to be discharged.

To accomplish the desired increases and decreases in quantity of coating material discharged, as dictated by the surface configuration of the channels 19 and 21, the master controller 36 controls the flow rate of pressurized air along tube 30 by means of regulator 38. For a portion which is flat, such as **19*b* and 21*b*, the standard reference for surface area passing gun 16 per unit time is 1.0 and the standard reference for quantity discharged is also 1.0. When a curved portion such as 19*c* moves in front of the gun 16, (adjacent portion 19*b*) the initial surface area which passes gun 16 per unit time is about 4.4 times the reference value region. As the angle of surface portion 19*c* decreases to about 30°, (adjacent portion 19*d*) the region which passes gun 16** per unit time is about 1.15 times the standard reference value.

Thus, the apparatus 10 opens up or closes down the flow passage in regulator 38, under the control of controller 36, to increase or decrease, respectively, the discharge rate from guns 16 and 16*a* relative to the surface area of the respective channel 19 or 21. Thus, for example, the flow passage through regulator 38 would be opened wider during the coating of portion 19*c*, than during the coating of portion 19*b*. This results in the most efficient use of the coating material, since excess coating material is not discharged onto flat portions, and additional material is discharged on curved portions to accomodate the additional surface area defined by the surface topography. Additionally, coating material is saved because the apparatus 10 does not discharge coating material toward cut-out regions, such as portion 21*e*.

For portions which are substantially parallel to the discharge path, such as portions 19*a*, 21*a*, 19*e*, and 21*g*, it is extremely difficult to uniformly coat the exposed surface area, due to the angular orientation of the surface with respect to the guns 16 and 16*a*. Therefore, it is desirable to electrostatically charge the powder particles to promote attraction toward these surfaces and uniform coverage thereof. As shown in FIG. 1, electrostatic charging of the powder particles may occur via use of corona charging electrodes 37 and 37*a* external to the guns 16 and 16*a*, respectively, though it is preferable to electrostatically charge the powder particles while in the apparatus 10, either via an internal corona electrode or an internal charging system such as a triboelectric friction charging system. Moreover, this type of electrostatic powder coating gun is preferably also used for coating the other portions of the article 12 as well.

Figure 3A:
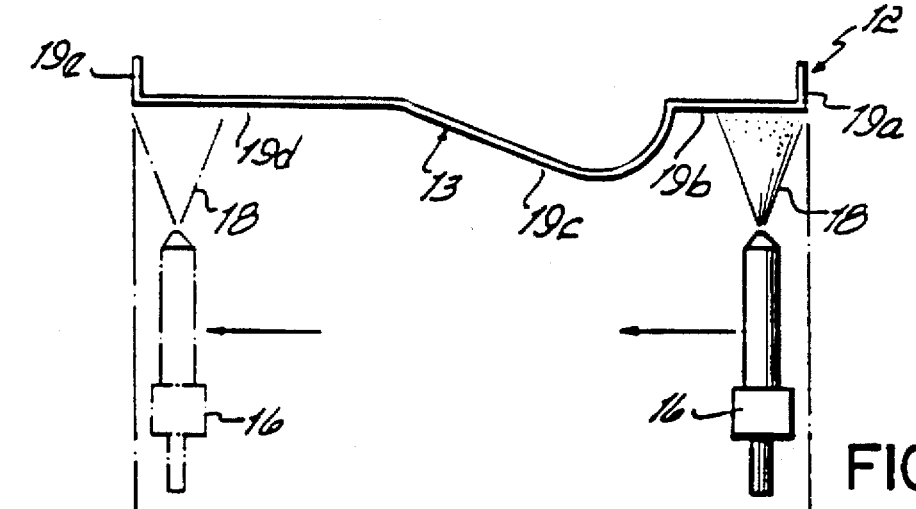
FIG. 3A is a plan view of one spray coating gun during coating of a first channel of the three dimensional article shown in FIG. 2.
Figure 3B:
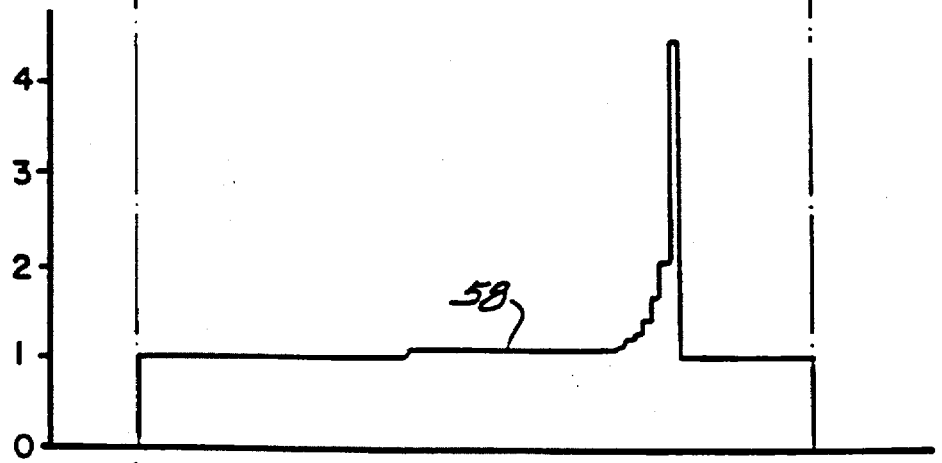
FIG. 3B is a graph which illustrates the surface area to be coated for the surface portions of the first channel shown in FIG. 3A.

FIG. 3A shows topographic channel 19 in plan view, and particularly surface portions 19*a*, 19*b*, 19*c*, 19*d* and 19*e*. FIG. 3B includes a curve 58 which graphically illustrates the surface area of channel 19 which passes in front of gun 16 during movement of the conveyor 14. For instance, the surface area represented for portions 19*a* and 19*d* are equal to the standard reference value 1.0. The surface area represented for the slightly inclined region of portion 19*c* is 1.15 times the reference value, while the surface area for the steeper region of portion 19*c* increases from 1.15 to 4.4 of the reference value. For curved portions such as 19*c*, FIG. 3B also reflects the slope of a tangent line to the surface.

Figure 3C:
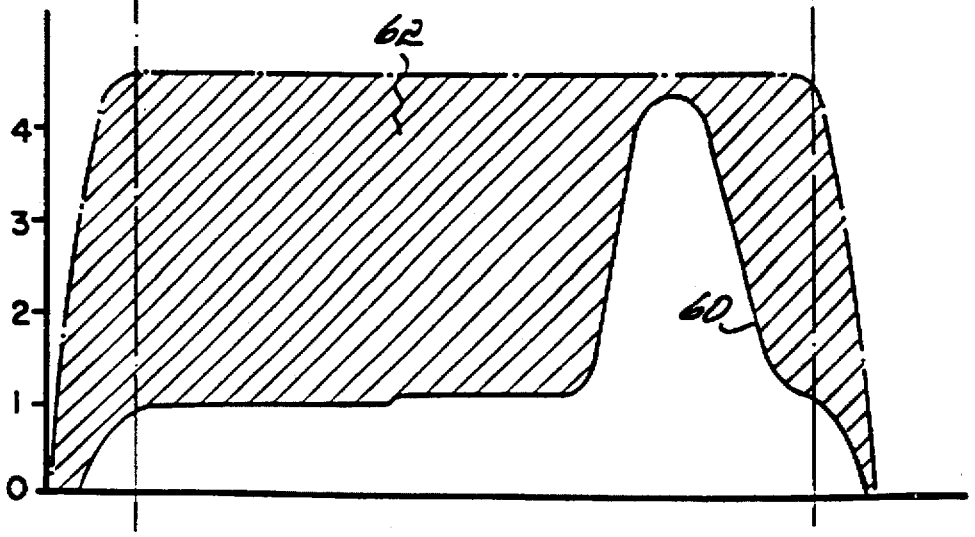
FIG. 3C is a graph which illustrates the quantity of coating material discharged as successive surface portions of the first channel move past the gun.

FIG. 3C graphically illustrates the quantity of coating material which should be discharged according to the invention as surface portions 19*a*, 19*b*, 19*c*, 19*d* and 19*e* pass in front of gun 16. This quantity is represented by curve 60. The shaded region located above curve 60, and designated by reference numeral 62, represents the amount of coating material that is saved by using this invention, since without this invention it would otherwise be necessary to discharge at a rate sufficient to cover the steepest region of surface portion 19*c*. The other option of course, though equally undesirable, would be to discharge at a rate insufficient to adequately coat the steepest region of surface portion 19*c*.

Figure 4A:
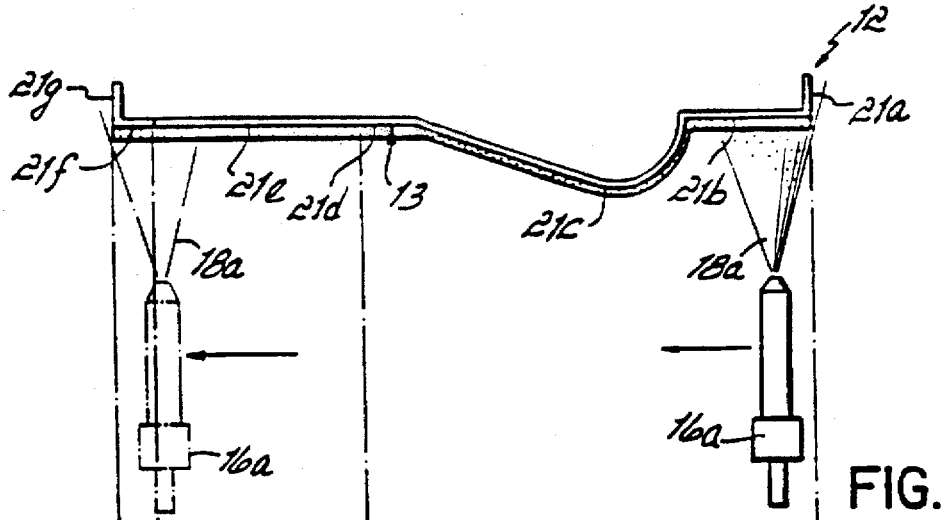
FIG. 4A is a plan view of a second spray coating gun during coating of a second channel of three dimensional article shown in FIG. 2.
Figure 4B:
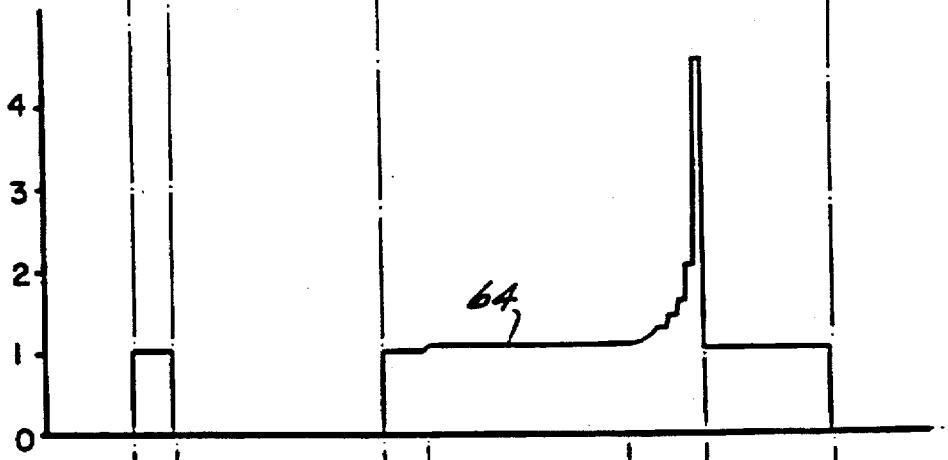
FIG. 4B is a graph which illustrates the surface area to be coated for the surface portions of the second channel shown in FIG. 4A.
Figure 4C:
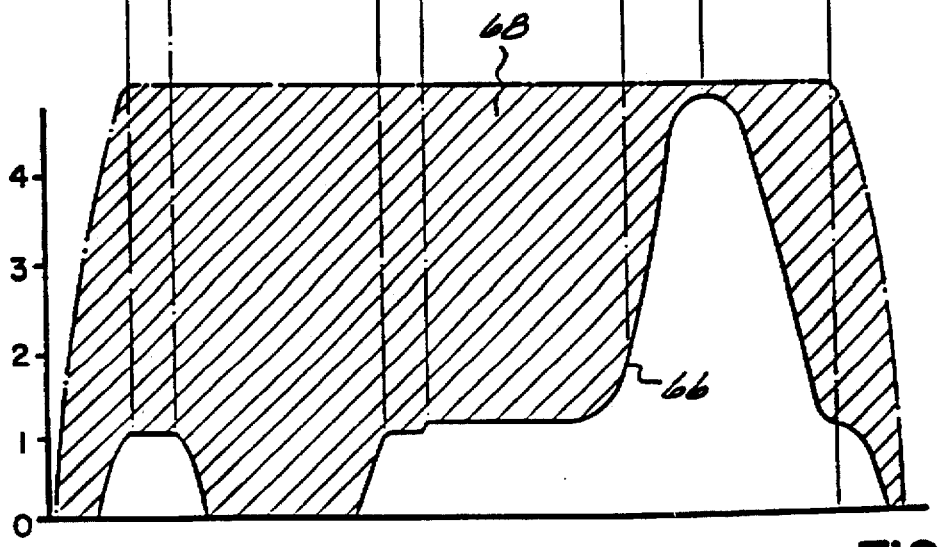
FIG. 4C is a graph which illustrates the quantity of coating material discharged as successive surface portions of the second channel move past the gun.

FIGS. 4A, 4B and 4C correspond to FIGS. 3A, 3B and 3C, respectively, but relate to coverage of second topographic channel 21. Curve 64 in FIG. 4B shows the surface area for portions 21*a*, 21*b*, 21*c*, 21*d*, 21*e*, 21*f* and 21*g* of channel 21, and curve 66 in FIG. 4C graphically shows the quantity of coating material discharged as these surface portions pass the gun 16*a*. Also, the reference numeral 68 designates the amount of coating material saved with this invention by varying the discharge rate.

Compared to FIGS. 3A, 3B and 3C, FIGS. 4A, 4B and 4C differ only in respect to the cut-out portion 21*e*, which does not require any coating material. The second discharge path 18*a* and the second gun 16*a* are necessary for coating article 12 because of the different surface configurations, or surface topography, represented by the cut-out region 21*e*. In some cases, as explained previously, additional or fewer guns may be needed, but the number of guns necessary will be determined by the transverse dimension of the article 12 and the number of topographic variations in the surface orientation of the article 12. The invention requires one gun, and therefore one topographic channel, for each variation and surface orientation across the transverse dimension of the article 12.

While the preferred embodiment of the invention has been described, it is to be understood that modifications may be made to the preferred embodiment without departing from the scope of the invention. Accordingly, applicant wishes to be bound only by the claims appended hereto.

We claim:

1. An apparatus for powder coating a three-dimensional article having an external surface with a plurality of surface portions having a plurality of different topographies, comprising:

a first gun aimed in a discharge direction;

means for conveying, relative to the gun, the article along a conveying path to successively convey the surface portions past the gun;

a powder pump operatively connected to the gun;

means for supplying fluidized powder particles to the pump;

means for supplying pressurized air to the pump via a flow path, the pump adapted to combine the pressurized air and powder particles in a mixed stream and to convey the mixed stream along a transport path to the gun for discharge therefrom along a discharge path toward the surface portions;

flow control means located in the flow path and adapted to regulate the flow of pressurized air therethrough, thereby to regulate the flow rate of the mixed stream conveyed to the gun and discharged therefrom along a discharge path; and a controller operatively connected to the flow control means, the controller adapted to control the flow control means to vary the discharge rate of the mixed stream from the gun according to a predetermined discharge sequence which corresponds to the topographies of the surface portions as said surface portions pass in front of the gun, so that a plurality of different discharge rates are used for the plurality of different topographies, thereby to promote uniform coating of the surface portions and reduced waste of powder particles during coating of the article.

2. The apparatus of claim 1 and further comprising:

a sensor operatively connected to the controller and adapted to sense the article as it moves in front of the gun and to signal the controller to initiate the predetermined discharge sequence.

3. The apparatus of claim 1 and further comprising:

speed sensing means operatively connected to the controller and adapted to determine the rate of speed of the conveying means, thereby to correlate the predetermined discharge sequence with the rate at which the surface portions pass in front of the gun.

4. The apparatus of claim 1 and further comprising:

an air pressure sensor located in the flow path between the flow control means and the pump; and display means operatively connected to the air pressure sensor for indicating the air pressure in the flow path.

5. The apparatus of claim 1 and further comprising:

means for electrostatically charging the particles in the mixed stream.

6. The apparatus of claim 5 wherein the electrostatic charging means is located in the discharge path.

7. The apparatus of claim 1 wherein the flow control means comprises an electro-pneumatic regulator which receives an electrical signal from the controller and in response varies the flow rate of pressurized air therethrough.

8. The apparatus of claim 1 wherein the gun remains in a fixed position and the conveying means comprises a conveyor which carries the article past the gun.

9. The apparatus of claim 1 and further comprising:

a second gun adapted to discharge pressurized air and powder particles in a second stream toward successively conveyed surface portions of the article, the second gun and the first gun arranged along a line perpendicular to the conveying path and the discharge direction.

10. A powder coating apparatus comprising:

a conveyor for conveying a three-dimensional article along a conveying path, the article having an external surface with a plurality of surface portions of different topography and surface area, wherein at least one of said portions is not parallel to the conveying path;

a first gun aimed along a first discharge path which intersects the conveying path;

means for flowing powder particles to the gun in a pressurized condition and for discharging the particles therefrom to powder coat the surface portions as the article is moved through the first discharge path via the conveyor, the means for flowing including means for supplying pressurized air to the gun, thereby to combine the pressurized air and the powder particles in a mixed stream for subsequent discharge from the gun and toward the surface portions; and a controller operatively connected to the means for supplying pressurized air and adapted to vary the flow of the pressurized air therefrom, thereby to variably control the rate of discharging of the powder particles in the mixed stream according to a predetermined discharge sequence so that the rate of discharging for each surface portion is commensurate with the surface area thereof and a different rate of discharging is used for each of the plurality of different topographies of the surface portions, thereby to uniformly powder coat the surface portions and to minimize waste of the powder particles.

11. The apparatus of claim 10 and further comprising:

a sensor operatively connected to the controller and adapted to sense the article as it moves in front of the gun and to signal the controller to initiate the predetermined discharge sequence.

12. The apparatus of claim 10 and further comprising:

speed sensing means connected to the controller and adapted to determine the rate of speed of the conveyor, thereby to correlate the predetermined discharge sequence with the rate at which the surface portions pass in front of the gun.

13. The apparatus of claim 10 and further comprising:

air pressure sensing means operatively connected to the flowing means and adapted to sense and display a parameter proportional to the rate of discharging.

14. The apparatus of claim 10 and further comprising:

means for electrostatically charging the particles in the mixed stream.

15. The apparatus of claim 10 wherein the gun remains in a fixed position and the conveyor carries the article past the gun.

16. The apparatus of claim 10 and further comprising:

a second gun adapted to discharge coating material along a second discharge path which intersects the conveying path as the article moves along the conveying path, the second gun and the first gun arranged along a line perpendicular to the conveying path and the first and second discharge paths.

17. A method of powder coating comprising the steps of:

moving a three-dimensional article to be powder coated along a conveying path relative to a spray gun, the gun aimed along a discharge path generally perpendicular to and intersecting the conveying path, the article having an external surface to be powder coated, the external surface having a plurality of surface portions of different surface topography and surface area;

mixing powder particles and pressurized air in the gun to form a mixed stream, the powder particles supplied by a powder source and the pressurized air supplied by a pressurized air source;

discharging the mixed stream from the gun along the discharge path to successively powder coat the surface portions as the article moves into the discharge path; and controlling the rate of discharging of the mixed stream according to a predetermined coating sequence by varying the flow of pressurized air from the pressurized air source, to provide a corresponding plurality of different rates of discharging the mixed stream, the rate of discharging being dependent upon the surface topography and the surface area of the surface portion located in the discharge path, thereby to uniformly powder coat the surface potions with optimized efficiency in use of powder.

18. The method of claim 17 and further comprising the step of:

electrostatically charging the discharged particles.

19. The method of claim 18 wherein the charging occurs inside the gun.

20. The method of claim 17 and further comprising the step of:

sensing the article as it moves into the discharge path, thereby to actuate a controller to initiate the predetermined coating sequence.

21. The method of claim 17 and further comprising the step of:

measuring the speed at which the article is moved through the discharge path and along the conveying path; and inputting the measured speed to a controller to control the predetermined coating sequence.

* * * * *